US006196172B1

(12) United States Patent
Cosfeld et al.

(10) Patent No.: US 6,196,172 B1
(45) Date of Patent: Mar. 6, 2001

(54) METHOD FOR CONTROLLING THE MOVEMENT OF AN ARMATURE OF AN ELECTROMAGNETIC ACTUATOR

(75) Inventors: Ralf Cosfeld, Munich; Konrad Reif, Oberschleissheim, both of (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 09/356,501

(22) Filed: Jul. 19, 1999

(30) Foreign Application Priority Data

| | | |
|---|---|---|
| Jul. 17, 1998 | (DE) | 198 32 196 |
| Aug. 11, 1998 | (DE) | 198 36 297 |
| Dec. 3, 1998 | (DE) | 198 55 775 |

(51) Int. Cl.[7] ..... F01L 9/04
(52) U.S. Cl. ..... 123/90.11
(58) Field of Search ..... 123/90.11; 251/129.01, 251/129.02, 129.05, 129.1, 129.15, 129.16; 361/152, 154, 187, 160; 324/207.16

(56) References Cited

U.S. PATENT DOCUMENTS

| | | | | |
|---|---|---|---|---|
| 4,544,986 | * | 10/1985 | Buchl | 361/152 |
| 5,481,187 | * | 1/1996 | Marcott et al. | 324/207.16 |
| 5,578,904 | * | 11/1996 | Marcott et al. | 324/207.16 |
| 5,600,237 | * | 2/1997 | Nippert | 324/207.16 |
| 5,682,127 | * | 10/1997 | Schmitz et al. | 335/228 |
| 5,868,108 | * | 2/1999 | Schmitz et al. | 123/90.11 |
| 5,905,625 | * | 5/1999 | Schebitz | 361/154 |
| 5,917,692 | * | 6/1999 | Schmitz et al. | 361/187 |
| 5,991,143 | * | 11/1999 | Wright et al. | 361/187 |
| 6,003,481 | * | 12/1999 | Pischinger et al. | 123/90.11 |
| 6,073,596 | * | 6/2000 | Kemper | 123/90.11 |

* cited by examiner

*Primary Examiner*—Teresa Walberg
*Assistant Examiner*—Vinod D. Patel
(74) *Attorney, Agent, or Firm*—Evenson, McKeown, Edwards & Lenahan P.L.L.C.

(57) ABSTRACT

The invention relates to a method for controlling the movement of an armature of an electromagnetic actuator, particularly for operating a charge cycle lifting valve of an internal-combustion engine, the armature being moved in an oscillating manner between two solenoid coils in each case against the force of at least one restoring spring by the alternating energizing of the solenoid coils, and, with an approach of the armature to the first-energized coil, during the so-called capturing operation, the electric voltage being reduced which is applied to the coil capturing the armature. The capturing phase of the capturing operation is followed by a braking phase in which, until the armature impacts on the coil, an electric voltage is applied to the latter in a switched manner, the respective switching points in time and the voltage switching ratio being determined by a controller by means of a desired trajectory describing the desired armature movement. Preferably, a positive or negative voltage value, whose amount is constant, or the "zero" voltage value is applied in a switched manner to the coil capturing the armature.

13 Claims, 4 Drawing Sheets

U
FP
BP
HP
0
t1
t2
t4
t

Z
z max
0
t2
t4
t

ż
t2
t4
t z̈
0
t2
ts
t3
t4
t

METHOD FOR CONTROLLING THE MOVEMENT OF AN ARMATURE OF AN ELECTROMAGNETIC ACTUATOR

BACKGROUND AND SUMMARY OF THE INVENTION

This application claims the priority of German patent documents 198 32 196.1, filed Jul. 17, 1998; 19855 775.2, filed Dec. 3, 1998; and 198 36 297.8, filed Aug. 11, 1998, the disclosures of which are expressly incorporated by reference herein.

The invention relates to a method for controlling the movement of an armature of an electromagnetic actuator, particularly for operating a charge cycle lifting valve of an internal-combustion engine, in which the armature oscillates between two solenoid coils against the force of at least one restoring spring, in response to alternating energizing of the solenoid coils. With an approach of the armature to the first-energized coil, during the so-called capturing operation, the electric voltage which is applied to the coil capturing the armature is reduced. An example of such a technical environment is disclosed in German Patent Document DE 195 30 121 A1.

A preferred use of an electromagnetic actuator of this type is in an electromagnetically operated valve gear of internal-combustion engines. That is, the charge cycle lifting valves of a reciprocating piston internal-combustion engine are operated by such actuators in the desired manner, being opened and closed in an oscillating fashion. In the case of such an electromagnetic valve gear, the lifting valves are moved individually or in groups by way of electromechanical control members (the so-called actuators), and the point in time for the opening and the closing of each lifting valve can be selected in an essentially completely free manner. As a result, the valve timing of the internal-combustion engine can be optimally adapted to the actual operating condition (defined by the rotational speed and the load) as well as to the respective demands with respect to consumption, torque, emissions, comfort and response behavior of a vehicle driven by the internal-combustion engine.

The essential components of a known actuator for operating the lifting valves of an internal-combustion engine include an armature, two solenoids (for holding the armature in the "lifting valve open" and the "lifting valve closed" position) with the pertaining solenoid coils, and restoring springs for the movement of the armature between the "lifting valve open" and "lifting valve closed" positions. For this purpose, reference is also made to the attached FIG. 1 which illustrates such an actuator with an assigned lifting valve in the two possible end positions of the lifting valve and of the actuator armature. Between the two illustrated conditions or positions of the actuator—lifting valve unit, the course of the armature lift z or of the armature path between the two solenoid coils, and the course of the current flux I in the two solenoid coils are illustrated over the time t corresponding to a known prior art (which is simpler than the initially mentioned German Patent Document DE 195 30 121 A1).

FIG. 1 shows the closing operation of an internal-combustion engine lifting valve 1 which moves in the direction of its valve seat 30. In a conventional manner, a valve closing spring 2*a* is applied to this lifting valve 1. The actuator, which as a whole has the reference number 4, acts upon the stem of the lifting valve 1—by means of a hydraulic valve compensating element 3 (which however, is not absolutely necessary). In addition to two solenoid coils

4*a*, 4*b*, this actuator 4 consists of a push rod 4*c* which acts upon the stem of the lifting valve 1 and carries an armature 4*d* which is guided to oscillate longitudinally between the solenoid coils 4*a*, 4*b*. A valve opening spring 2*b* is also applied to the end of the push rod 4*c* facing away from the stem of the lifting valve 1.

This is therefore an oscillatory system for which the valve closing spring 2*a* and the valve opening spring 2*b* form first and second restoring springs, for which therefore in the following the reference number 2*a*, 2*b* will also be used. The left-hand side of FIG. 1 shows the first end position of this oscillatory system, in which the lifting valve 1 is completely open and the armature 4*d* rests on the lower solenoid coil 4*b* (hereinafter also called an opener coil, since it holds the lifting valve 1 in its open position). The right-hand side of FIG. 1 shows the second end position of the oscillatory system in which the lifting valve 1 is completely closed and the armature 4*d* rests against the upper solenoid coil 4*a* (hereinafter also called a closer coil, since it holds the lifting valve 1 in its closed position).

In the following, the closing operation of the lifting valve 1 will be briefly described; that is, in FIG. 1, the transition from the left-side condition into the right-side condition. In between, the corresponding courses of the electric currents I flowing in the coils 4*a*, 4*b* as well as the lifting course or the path coordinate z of the armature 4*d* are each entered over the time t. With respect to the path constant z, the value $z_0$ corresponds to a completely open lifting valve 1 (the armature 4*d* resting on the opener coil 4*b*), while in the case of $z=z_1$, the armature 4*d* rests against the closer coil 4*a*.

Starting from the left-side "lifting valve open" position, the opener coil 4*b* is energized first in order to hold the armature 4*d* in this position against the tensioned valve closing spring 2*a* (=lower first restoring spring 2*a*), and the current I in the coil 4*b* is illustrated by a broken line in the I-t diagram. If the current I of the opener coil 4*b* is now switched off for a desired transition to "lifting valve closed", the armature 4*d* detaches from this coil 4*b* and the lifting valve 1 is accelerated by the tensioned valve closing spring 2*a* approximately to its center position (upwards). Because of its mass (moment of inertia) it continues to move, and in the process tensions the valve opening spring 2*b* so that the lifting valve 1 (and the armature 4*d*) are braked. Subsequently, the closer coil 4*a* is energized at a suitable point in time. (In the I-t diagram, the current I for the coil 4*a* is illustrated by a solid line.) In this manner, this coil 4*a* captures the armature 4*d* (the so-called capturing operation), and finally holds it in the "lifting valve closed" position illustrated on the right-hand side. After the armature 4*d* has been securely captured by the coil 4*a*, a switching takes place in the latter to a lower holding current level (compared I-t diagram).

The reverse transition from "lifting valve closed" to "lifting valve open" takes place analogously, from the position illustrated on the right-hand side in FIG. 1, by switching off the current I in the closer coil 4*a* and a time-shifted switching-on of the current for the opener coil 4*b*. In general, for energizing the coils 4*a*, 4*b*, a sufficient electric voltage is applied to them, while the switching-off of the electric current I is initiated by a reduction of the electric voltage to the "zero" value. The required electric energy for the operation of each actuator 4 is taken either from the electrical system of the vehicle driven by the pertaining internal-combustion engine or is provided by way of a separate energy supply adapted to the valve gear of the internal-combustion engine. In this case, the electric voltage is kept constant by means of the energy supply, and the coil current I of the actuators 4 assigned to the internal-combustion engine lifting valves 1 is controlled by a control apparatus, such that the required forces for the opening, closing and holding of the lifting valve or valves 1 in the respective desired position are obtained.

In the case of the above-explained state of the art, during the so-called capturing operation (in which one of the two coils 4*a*, 4*b* endeavors to capture the armature 4*d*), the coil current I is controlled by the above-mentioned control apparatus or by a control unit, by timing to a constant value which is high enough for securely capturing the armature 4*d* under all conditions. Now the force of the capturing solenoid coil 4*a* or 5*b* onto the armature 4*d* is approximately proportional to the current I and inversely proportional to the distance between the coil and the armature. If now - as in the known state of the art—a constant current I is adjusted, the magnetic force acting upon the armature 4*d*, with its approach to the respective coil 4*a* or 4*b* capturing it, rises inversely proportionally to the remaining gap, whereby the armature acceleration and armature speed rise. This results in a high impact speed of the armature 4*d* onto the respective solenoid coil 4*a* or 4*b*, which not only leads to high wear in the actuator 4, but also generates considerable noise. Another disadvantage is the switch-over loss of the transistors, which occur in the case of the briefly described switched current control and result in an increased power consumption and temperature-caused stress of the control apparatus, as well as in an increased electromagnetic radiation in the feeds of the actuators.

Improvements, particularly with respect to the generation of noise and wear of the actuator, are provided by the initially mentioned German Patent Document DE 195 30 121 A1 which discloses a method for reducing the impact speed of an armature onto an electromagnetic actuator. With an approach of the armature to the pole surface of the coil capturing the armature, the voltage applied to the coil is limited (that is, essentially reduced) to a definable maximal value so that the current flowing through the coil drops during a part of the time of the voltage limitation. The extent of the voltage limitation or voltage reduction can be defined in a characteristic diagram; thus, the corresponding values and particularly also the respective point in time at which this voltage reduction is to start must be determined experimentally.

It is an object of the present invention to provide further improvements with respect to the above; that is, to provide a simple and efficient method for reducing the impact velocity of an armature of an electromagnetic actuator.

This object is achieved by the method according to the invention, in which the capturing phase of the capturing operation is followed by a braking operation in which a switched electric voltage is applied to the coil until the armature impacts on the coil. The respective switching points in time and the voltage—switching ratio are determined by a controller by means of a desired trajectory describing the desired movement of the armature.

In a preferred embodiment of the invention, in addition to the voltage—switching ratio, the controller also determines the preceding sign of the voltage value whose amount is constant. That is, in a switched manner, either a positive or a negative voltage value or the "zero" voltage value is applied to the coil capturing the armature.

In general, it is suggested according to the present invention to replace the known current control or voltage reduction (which is to be determined empirically) during the capturing operation by a control which, during the so-called braking phase of the capturing operation, shortly before the armature impacts on the magnetic coil capturing it, applies electric voltage to this coil in a controlled manner, (specifically in a switched manner). The respective switching points in time for the switching-on and switching-off of the electric voltage (as well as optionally also their preceding signs) are determined by means of a desired trajectory describing the desired movement of the armature.

Other objects, advantages and novel features of the present invention will become apparent from the following detailed description of the invention when considered in conjunction with the accompanying drawings.

DETAILED DESCRIPTION OF THE DRAWINGS

The term "trajectory" is known to a person skilled in control technology, and describes a path of an object to be moved in a controlled manner by means of a controller in a structural space (in the present case, the path of the armature between the two solenoid coils). This desired trajectory preferably comprises, as a function of time (conventionally called "t"), values for the position of the armature (in the following also called "path coordinate), as well as its velocity and acceleration. That is, it is virtually a simple value table, which can either be fixedly stored in a suitable control unit or can in each case be individually calculated in a manner explained below. Tests and calculations have shown that it is sufficient to provide such a desired trajectory for the control only in the above-mentioned braking phase because, at the point in time when the control is activated, the armature (still moving in the capturing phase) is always in such a condition in which its position (that is, the path coordinate), velocity and acceleration are at an essentially constant ratio with respect to one another (at least within the scope of the conditions required for the present usage).

Figure 1D:
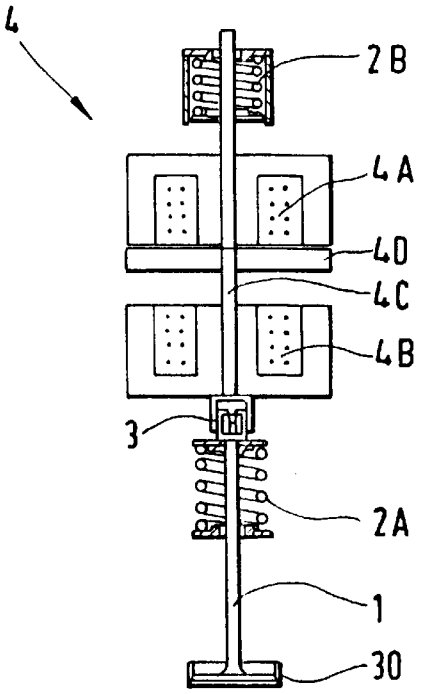
FIG. 1 illustrates a closing operation of an internal combustion engine lifting valve.
Figure 1B:
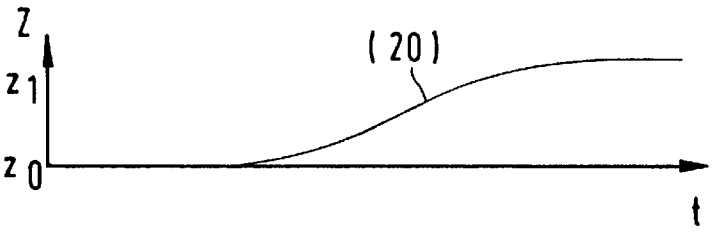
Figure 1C:
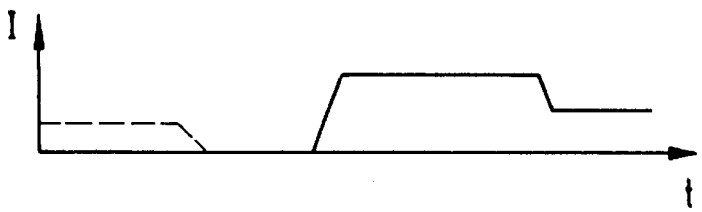
Figure 1A:
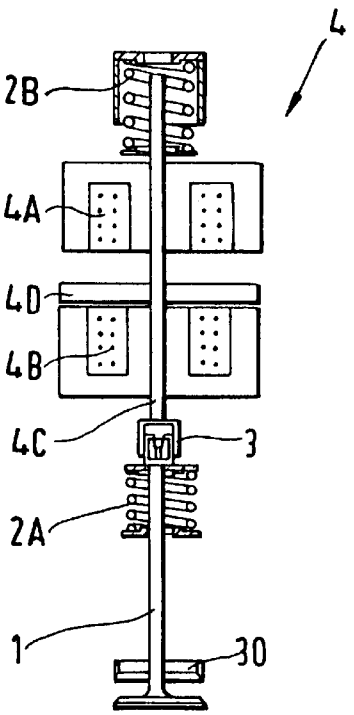
Figure 2:
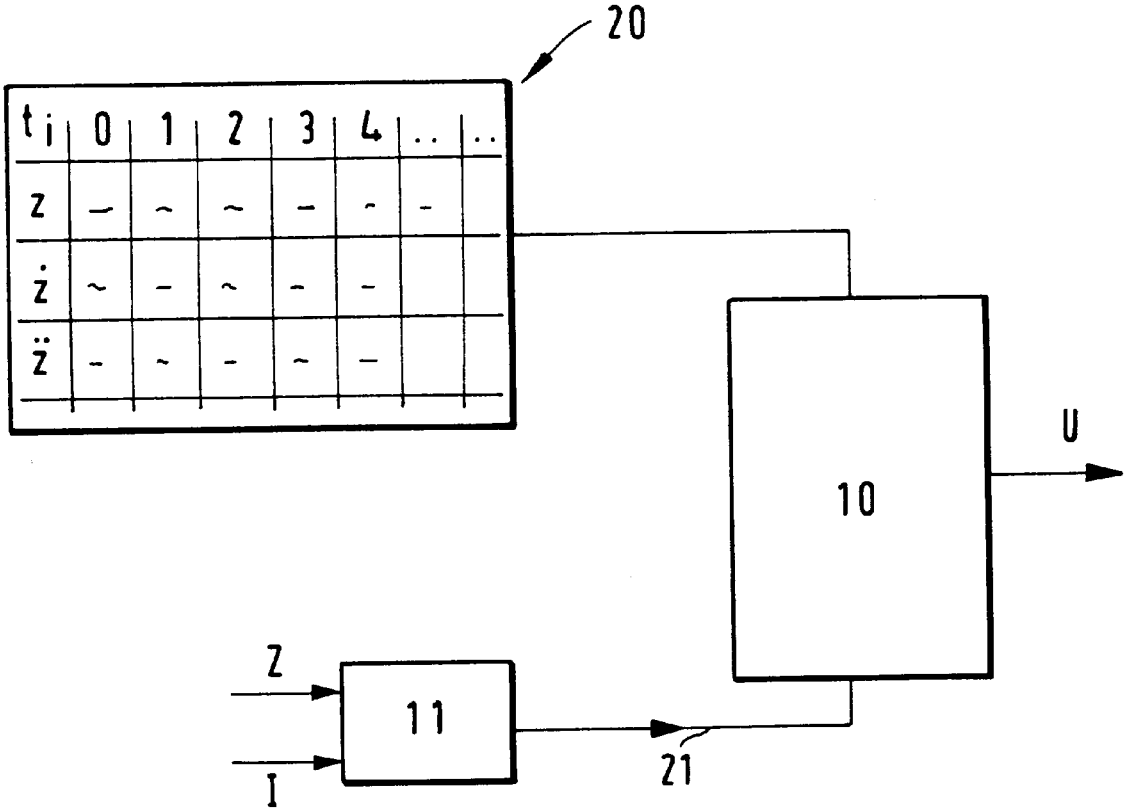
FIG. 2 is a conceptual block diagram for performing the control method according to the invention.

FIG. 2 is a conceptual block diagram of the corresponding control, which includes a controller 10. Control is effected by means of the signals of a desired trajectory 20 describing the desired armature movement, with the controller 10 also processing signals of an observer 11 arranged next to the desired trajectory 20. The output quantity of the control concept or of the controller 10 is the electric voltage U applied to or present at the coil 4*a* or 4*b* which in each case captures the armature 4*d* (compare FIG. 1). This voltage U preferably has a magnitude, and is applied by the controller 10 in a timed manner to the respective coil 4*a* or 4*b*. The controller 10 can continue to determine the preceding sign of the electric voltage; that is, in a switched manner, either a positive or a negative voltage value or the "zero" voltage value is applied to the coil 4*a* or 4*b* capturing the armature 4*d*.

The position of the armature 4*d* between the coils 4*a*, 4*b* (corresponding to the course of the lifting of the lifting valve 1 or of the armature 4*d* as the result of the path coordinate z, which is measured in an appropriate manner) is an input to the controller described here, which is further processed by the observer 11. For reasons of simplicity, in the following directly the position of the armature will be called "z", without using the explanatory term "path coordinate".

Based on this path coordinate or armature position z, the movement velocity $\dot{z}$ of the armature as well as the armature acceleration z can be estimated or determined by way of a first or second derivative over the time t. The value z and the derived values $\dot{z}$, $\ddot{z}$ are determined by the observer 11 and are reported to the controller 10 as so-called estimated values 21.

Another input value of the controller described here (which is processed by the observer 11 when determining the estimated values 21), is the current conduction I determined in the respective coils 4*a*, 4*b* (compare FIG. 1) (specifically as the result of the applied voltage U).

FIGS. 3*a*, 3*b*, 3*c*, 3*d* show the individual phases of the control according to the invention during the capturing operation of the armature 4*d* by one of the two coils 4*a*, 4*b* in a system according to FIG. 1.

Figures 3A, 3B, 3C, 3D:
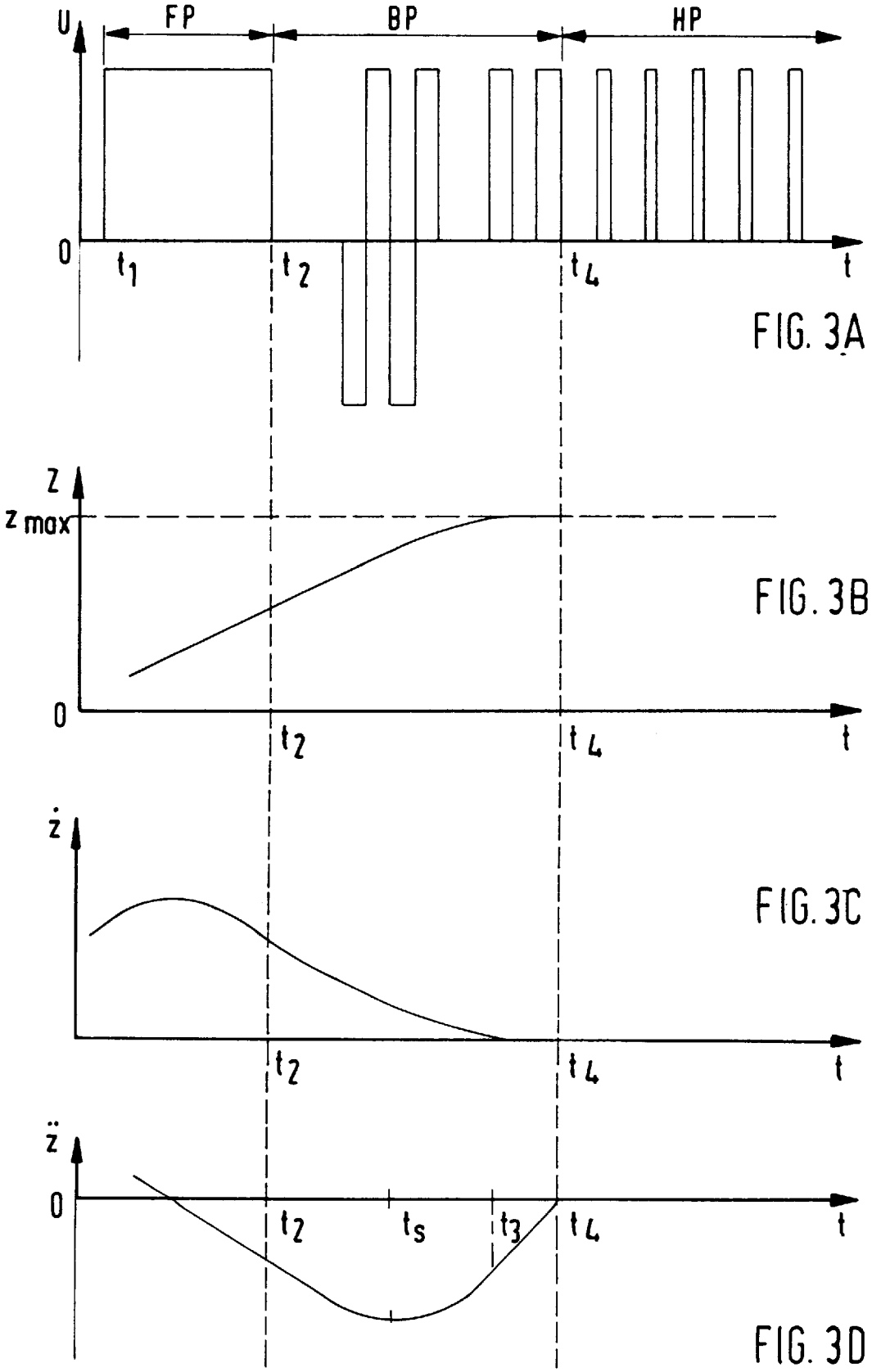
FIGS. 3*a*–3*d* are graphic depictions for explaining the operation of a first embodiment of the invention.

FIG. 3*a* shows the individual phases according to the invention, specifically the capturing phase FP, the braking phase BP and the holding phase HP which follows the impacting of the armature on the coil. The electric voltage U applied to the solenoid coil capturing the armature is in each case entered over the time t, while FIG. 3*b* illustrates the pertaining path coordinate z of the armature 4*d* (that is, the armature position z, which assumes values between z=0 and $z=z_{max}$).

As far as the start of the capturing phase FP at the point in time $t_1$ is concerned, at which the coil capturing the armature is acted upon by electric voltage U, this switch-on point in time $t_1$ can basically be freely selected within certain limits. It need only be ensured that the armature 4*d* can still be captured at all. For reasons of simplicity, however, it is advantageous that the voltage U be switched on when the armature position z exceeds a certain selectable threshold value. Basically, this threshold value may also be variable, whereby additional marginal conditions, such as different exterior forces acting upon the lifting valve 1 to be moved (particularly gas forces) in different operating points of the internal-combustion engine can be taken into account.

According to the invention and as illustrated in FIG. 3*a*, the controller 10 divides the whole capturing operation of the armature 4*d* into two phases, specifically:

first, a capturing phase FP, and secondly, a braking phase BP which follows.

The latter phase (after the impact of the armature 4*d* on the respective coil 4*a* or 4*b*) is followed by the conventional holding phase HP, in which the armature 4*d*, after it has securely impacted on the respective solenoid coil 4*a* or 4*b*, is held on it. For this purpose, a switch-over takes place to a holding current control, which as illustrated above, occurs by a switched action of the (equivalent) electric voltage U onto the respective coil 4*a*, 4*b*.

In the braking phase BP, which is essential to the invention, after the known capturing phase FP, at the point in time $t_2$, first the voltage supply of the respective coil 4*a* or 4*b* capturing the armature 4*d* is interrupted. This starts the braking phase BP in which the electric voltage U (whose amount is constant) is then applied in a switched (and preferably preceding-sign-variable manner) to the respective coil 4*a*, 4*b*. (In this manner, a current conduction I is initiated.) The respective points in time for the switching-off and connecting of the voltage U whose amount is constant (that is, the so-called voltage—switching ratio) as well as in addition the preceding sign of the voltage U (that is, the selection between a negative and a positive voltage value) are determined by the controller 10.

The operation of the controller 10 can be described as follows: To achieve a desired reduction of its impact velocity on the respective coil 4*a* or 4*b* and capture it, the armature 4*d* (compare FIG. 1) must be braked in a controlled manner already in its flight phase (that is, before its actual impact), specifically in the so-called braking phase BP. However, this braking phase BP should not unnecessarily prolong the opening and closing time of the internal-combustion engine lifting valve 1 operated by the actuator 4.

To design a controller 10 which meets these demands, suitable state variables for the armature movement must be selected. Preferably, in addition to the armature position z and the armature velocity $\dot{Z}$ (which can basically be determined by the time-related differentiation of the armature position z), the armature acceleration $\ddot{z}$ is selected as the third state variable because, as a direct derivation of the armature velocity $\dot{z}$, it represents a variable which can also be easily interpreted. However, in principle, the control can also be constructed of other state variables.

During the braking phase BP, for carrying out its desired function (specifically causing the armature 4*d* to be deposited as softly and jolt-free as possible on the respective solenoid coil 4*a*, 4*b* capturing it), the controller 10 can use a so-called desired trajectory 20 which contains values, which as a function of the time t correlate with one another, for the position z, the velocity $\dot{z}$ and the acceleration $\ddot{z}$ of the armature. This desired trajectory 20 is therefore nothing else than a value table of desired values as illustrated in a simplified manner in FIG. 2.

If, during the operation of the electromagnetic actuator 4, the actual values for the position z, the velocity $\dot{z}$ and the acceleration $\ddot{z}$ of the armature 4*d* deviate excessively from the desired values, the controller 10 will correct this by a suitable connection or disconnection of the voltage U (including any required variation of its preceding signals). The detailed layout of the controller 10 can take place by different processes of the linear and non-linear control theory and will not be discussed here in detail.

The value table or desired trajectory 20 may be calculated, among other ways, from the marginal condition that the acceleration z of the armature 4*d* at the point in time of the impacting on the respective solenoid coil 4*a* or 4*b* must have the "zero" value. (That is, the armature 4*d* impacts without any jolts on the coil 4*a* or 4*b*.) Other marginal conditions are naturally the defined position of the armature 4*d* when impacting (specifically $z=z_{max}$) as well as the then valid value of the armature velocity $\dot{z}=0$ (zero)

For further explanations, reference is made to FIGS. 3*b*, 3*c*, 3*d*. Here, the position z (FIG. 3*b*), the (desired) armature velocity $\dot{z}$ (FIG. 3*c*) as well as the (desired) armature acceleration $\ddot{z}$ (FIG. 3*d*) in each case in the end phase of the armature movement (that is, before the impacting of the armature 4*d* on the coil 4*a* or 4*b* capturing it) are entered again above time t. The time period is essentially illustrated between $t_2$ (the end point of the capturing phase FP, at which the constant voltage is switched off and the actual control operation is started) and the depositing point in time $t_4$ (essentially the braking phase BP).

On the left side of $t_2$, in capturing phase FP, the armature 4*d* moves toward the coil capturing it. In this case, as illustrated, the acceleration $\ddot{z}$ does not only decrease during phase FP, but even assumes negative values, because, with this approach movement, for example, to the coil 4*a*, the pertaining restoring spring 2*b* (compare FIG. 1) is tensioned. That is, the armature 4*d* is already braked in its flight velocity z by means of the restoring spring 2*b*.

The actual control operation will now start at the point in time $t_2$. (That is, the braking phase BP is started.) By means of the controller 10, the braking phase should now be ideally designed such that of the armature 4*d* is deposited gently on the coil 4*a* (or 4*b*). That is, at the depositing point in time $t_4$, the acceleration z must again have the "zero" value.

As illustrated in the $\ddot{z}$-t diagram of FIG. 3*d*, this ideal and therefore desired acceleration course, between a point in time $t_3$ (which is later than $t_2$) and the depositing point in time $t_4$, can be approximated very well by a straight line; and between the points in time $t_2$ and $t_3$ can be approximated very well by a parabola.

The following relationships therefore apply to $t_3<t_4$:

$$+\ddot{i}\,\ddot{z}+\ddot{I}\,(t)=j\cdot(t_4-t)$$

$$+\dot{i}\,\dot{z}+\dot{I}\,(t)=j/2\cdot(t_4-t)^2$$

$$z(t)=j/6\cdot(t_4-t)^3+z_e$$

The formulas for $\ddot{z}(t)$ and for z(t) are obtained from a time-related integration of the acceleration $\ddot{z}(t)$ while taking into account the relevant marginal conditions, wherein "j" is a constant.

Furthermore, the following relationships apply to $t_2<t<t_3$:

$$+\ddot{i}\,\ddot{z}+\ddot{I}\,(t)=a_0+a_1\cdot t+a_2\cdot t^2$$

$$+\dot{i}\,\dot{z}+\dot{I}\,(t)=\dot{z}_0+a_0\cdot t+a_1/2\cdot t^2+a_2/3\cdot t^3$$

$$z(t)=z_0+\dot{z}_0\cdot t+a_0/2\cdot t^2+a_1/6\cdot t^3+a_2/12\cdot t^4$$

The constants $z_0$, $\dot{z}_0$, $\alpha_0$, $\alpha_1$ and $\alpha_2$ are to be determined from the continuity conditions for $\ddot{z}$, $\dot{z}$ and z at the point in time $t_3$, two of these constants being freely selectable. Preferably, the values for $\alpha_0$ as well as the position of the apogee of the above-mentioned parabola (at the point in time $t_s$) can be arbitrarily selected within certain limits.

It should be noted that it is not absolutely necessary to represent the above-mentioned desired trajectory as above in each case by a portion of a straight line and a parabola. Other mathematical-geometrical functions, such as polynomials, a sine function or similar functions, can also be used.

As indicated above, the controller 10 requires three state variables for carrying out its function, specifically preferably the armature position z, the movement velocity $\dot{z}$ of the armature 4*d* as well as the armature acceleration $\ddot{z}$. In principle, it is possible to measure these state variables by means of suitable sensors. However, in order to save sensors or replace high-cost sensors by low-cost sensors, at least two of these state variables can also be reconstructed by a so-called observer 11, which had been briefly discussed in connection with FIG. 2.

In this observer 11, an actuator model is connected in parallel to the actuator 4 (FIG. 1). The model is supplied with an actual variable essential to the actuator 4 (specifically the current conduction I determined in the respective coil 4*a*, 4*b*). The observer 11, compares the armature position estimated on this basis with the actually measured armature position z which is (also supplied to the observer 11 as an input variable), and the difference can then be fed back by way of a correction function onto the variables or so-called state variables of the actuator model. In the event of a model error or a faulty estimation of the initial conditions, the observer 11 uses a correction function stored therein to adapt the estimated values for (here) the armature position z, the velocity $\dot{z}$ and acceleration $\ddot{z}$ to the respective actual values. (It should be noted once again that, as an alternative to the above-mentioned values z, $\dot{z}$, $\ddot{z}$, other suitable variables or state variables can also be used for characterizing the actuator state).

The designing of the above-mentioned correction function can take place by different methods of linear or non-linear control theory, which are well known to those skilled in the art, and need not be discussed here in detail.

Significant advantages of the method according to the invention result from the use of the controller 10 utilizing a desired trajectory.

The suggested complete state feedback, in principle, permits the representation of arbitrarily low impact velocities of the armature 4*d* on the respective solenoid coil 4*a* or 4*b*. In particular, the invention permits the armature 4*d* to impact on the respective coil without jolts (that is, at an acceleration $\ddot{z}$ at the "zero" value), so that the noise generated as the result of this impacting at the point in time $t_4$ is minimized. As the result of the desired trajectory calculated beforehand or in a suitable electronic control system in the background, real-time computing expenditures during the actual control operation are minimized.

Thus, in the above-mentioned preferred application, the calculation of the desired trajectory permits adaptation during operation of the internal-combustion engine, specifically as a function of its actual operating condition, such as the rotational speed, load moment, temperature, wear and more. In addition, the problem of measuring all required variables is solved by the use of the observer 11 based on the measured variables valve lift and armature position z and coil current I.

In the following, the above method for controlling the movement of an actuator armature for the operation of an internal-combustion engine lifting valve is supplemented for the purpose of other applications. As a result, different desired trajectories are provided for different movement sequences of the armature and/or of the charge cycle lifting valve. In the following description, the so-called desired trajectory is illustrated in a simplified manner only by the desired movement course of the armature 4*d* and is marked by the reference numbers 20 or 20*a*, 20*b*, 20*c*, . . . .

By means of such a further development, it is therefore possible to move both the armature 4*d* and the lifting valve 1 in the desired manner not only into their respective end positions, but in other movement sequences as well. Examples of possible further movement sequences are illustrated in the form of desired trajectories 20*a*, 20*b*, 20, which, as mentioned above, are shown in a simplified manner, in FIGS. 4, 5. Over time t, the course of the path coordinate z of the armature 4*d* is illustrated similarly to the representation of the desired trajectory 20 in FIG. 1.

Figure 4:
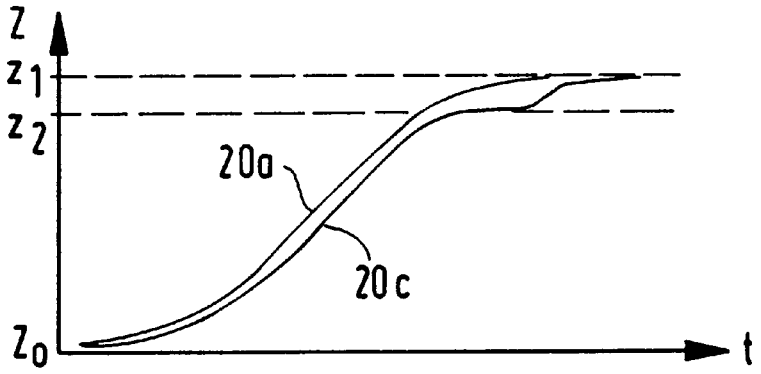
FIGS. 4 and 5 are graphic depictions for explaining a further embodiment of the invention.
Figure 5:
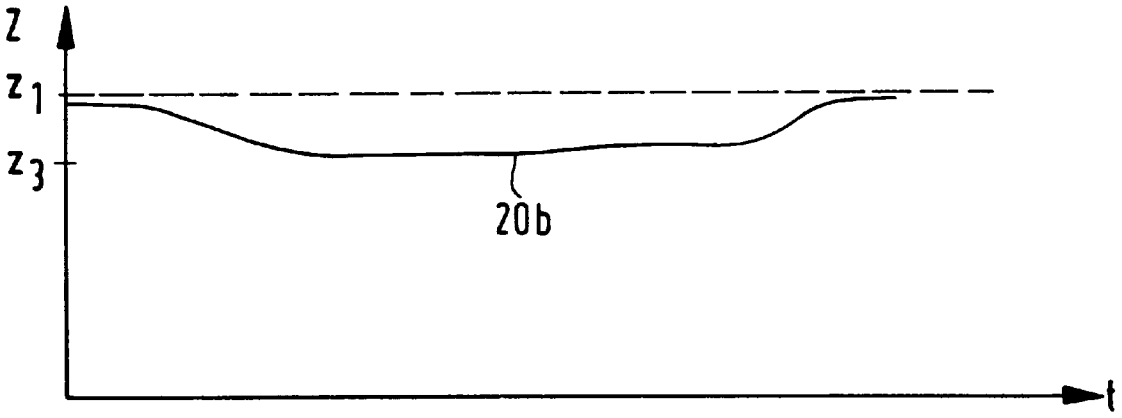

Thus, in addition to a desired trajectory 20*a* (compare FIG. 4), which leads the lifting valve 1 into its completely open position, at least one desired trajectory 20*b* can be provided which is illustrated in FIG. 5 and opens the lifting valve 1 only partially. The representation according to FIG. 5 differs from that of FIGS. 1, 4 in that FIG. 5 shows an opening and a closing movement of the lifting valve 1; that is, the time axis (t) extends over a longer time period than in FIGS. 1, 4. In this case, the lifting valve 1 (as illustrated) can preferably be held close to its closed position by means of the desired trajectory 20*b*, which opens it only partially. That is, the amount of change of the path coordinate z of the armature 4*d* operating the lifting valve 1 is relatively low so that, based on the closed lifting valve 1 or based on $z=z_1$ (that is, the armature 4*d* rests against the closer coil 4*a*), only the low armature lift $z=z_3$ or the path coordinate $z_3$ is reached.

Using the above-mentioned controller, by means of such a desired trajectory 20*b*, a floating position of the armature 4*d* can be set in a quasi-fictitious end position in which the armature 4*d* remains at least slightly spaced away from the closer coil 4*a* which has just released it. Thus, for example, during an opening movement of the lifting valve 1, not the opener coil 4*b* (compare also FIG. 1) but a fictitious end position (specifically $z=z_3$) of the armature 4*d* in the vicinity of the closer coil 4*a* is approached, which corresponds, for example, to a minimal valve lift of the lifting valve 1 of approximately 1 mm to 2 mm. If the armature 4*d*, and thus the lifting valve 1, are held in a floating condition in such a position (for example, $z_3$), in a corresponding operation of an internal-combustion engine intake valve, thereby achieving an improved mixture processing. Also, in the operation of the internal-combustion engine exhaust valve, it optimizes the charging movement, as basically known to a person skilled in the field of internal-combustion engines.

Furthermore, particularly for the closing operation of the lifting valve 1, a desired trajectory 20*c* can be provided which holds the armature 4*d* at least for a short time slightly spaced away from the corresponding solenoid coil or closer coil 4*a*. As illustrated in FIG. 4, in this case also, beginning from $z=z_0$, first the armature approaches a first quasi end position 4*d* which is defined by $z=z_2$. The armature 4*d* remains in this posiiton at least slightly spaced away from the coil 4*a* capturing it, after which a second armature end position is approached which corresponds to its mechanical end position, specifically $z=z_1$. As a result, an electronic valve play compensation in the lifting valve gear of the internal-combustion engine is virtually possible. Therefore, during a closing operation of the internal-combustion engine lifting valve 1, the armature 4*d* is first moved toward the position $z_2$, which corresponds to the depositing of the lifting valve 1 on its valve seat 30 (compare FIG. 1). Subsequently, the armature 4*d* is moved into position $z_1$ which corresponds to its own mechanical end position in which it therefore comes to rest on the closer coil 4*a*.

In addition, during a subsequent opening of the lifting valve 1, the armature 4*d* first approaches a first virtual end position corresponding to the valve play (that is, again position $z=z_2$) Subsequently, it can approach a second end position which corresponds to the mechanical end position of the armature 4*d* on the opener coil 4*b* (specifically $z=z_0$) so that, after (or because of) the overcoming of the valve play, in position $Z_2$, the armature 4*d* impacts as softly as possible on the stem of the lifting valve 1.

Instead of the mechanical end positions of the armature 4*d* on the solenoid valves 4*a*, 4*b*, generally fictitious or so-called quasi end positions of the armature 4*d* (situated between $z_0$ and $z_1$) can be approached. That is, desired trajectories are provided (not illustrated in the figures) which move the lifting valve 1, for example, into its end position and in the process hold the armature 4*d* spaced away from the respective solenoid coil 4*a* or 4*b*. As a result, a so-called floating position of the armature 4*d* is set in a fictitious or quasi end position in which the armature 4*d* remains at least slightly spaced away from the coil 4*a* and 4*b* capturing it. Thus, instead of the mechanical end position of the armature 4*d* during the opening and/or closing of the lifting valve 1, a fictitious end position in front of the respective solenoid coil 4*a* or 4*b* is approached, and the armature is held in this floating intermediate position by the initially mentioned controller, which processes the corresponding desired trajectory. Because the armature 4*d* does not impact on the respective coil 4*a* or 4*b*, noise in the valve gear is considerably reduced.

As indicated initially, these different desired trajectories 20, 20*a*, 20*b*, 20*c* . . . are processed in an electronic controller which causes a corresponding action on the respective solenoid coil 4*a* and/or 4*b* at a suitable voltage—switching ratio. In order to ensure a high ruggedness of this controller, all provided desired trajectories 20, . . . are defined as a quantity of operating conditions in which the controlled system, (specifically the electromagnetic valve gear for the charge cycle lifting valve 1) has the desired performance. This considered system must now be brought into the desired operating condition corresponding to the respective desired trajectory, such that it does not leave this operating condition until the conclusion of the respective movement sequence. Under suitable conditions, this can take place by a discontinuous control signal analogous to a two-position controller. Under certain conditions, the desired operating states can be selected irrespective of deviations or disturbances, so that the controlled system is largely independent of deviations and disturbances.

Significant advantages which are achieved by this method which uses a controller and different desired trajectories 20, 20*a*, 20*b*, 20*c*, . . . .

The suggested complete condition feedback permits in principle the representation of arbitrarily low impact velocities of the armature 4*d* on the respective solenoid coil 4*a* and 4*b*. However, if the armature 4*d* does not at all impact on the respective coils 4*a*, 4*b*, the connected impact noise will disappear completely. Furthermore, the other wear phenomena caused by the impact are largely eliminated.

Within certain limits, which, among others, are determined also by the restoring springs 2*a*, 2*b* and by the magnetic design as a whole, the lift of the actuator 4 and thus also of the lifting valve 1 can be arbitrarily adjusted and be changed for each individual opening and closing operation.

Finally, the hydraulic valve play compensation, which is otherwise required in the case of a mechanical internal-combustion engine valve gear 1, can be eliminated; and the (existing, because always required) valve play can be compensated electromagnetically.

So far, it has been described in general terms that the movement of the armature of the electromagnetic actuator is controlled so that the electric voltage applied to the coil which is situated closer to the armature (and is therefore energized) is switched; and the voltage—switching ratio is determined by a controller by means of a desired trajectory describing the desired movement of the armature. In this case, the controller and/or the desired trajectories can be adapted to different operating conditions of the internal-combustion engine. It was also mentioned that the calculation of the desired trajectory permits an adaptation during the operation of the internal-combustion engine, specifically as a function of its current operating condition, such as the rotational speed, the load moment, the temperature, the wear and more. The reason is that the dynamic performance of the actuator, particularly because of the gas forces acting upon the charge cycle lifting valve, is significantly dependent on the load condition and on the rotational speed of the internal-combustion engine. In addition, changes of the component temperatures and particularly of the temperature of the internal-combustion engine lubricating oil as well as general wear phenomena can result in a change of the mechanical characteristics of the actuator.

It will now be demonstrated how at least one of the above-mentioned adaptations can be carried out in a particularly efficient manner. Accordingly, the adaptation to different internal-combustion operating conditions with respect to their type can take place beforehand by means of a numerical optimizing algorithm, and can be filed in a electronic control unit. An additional adaptation of the controller and/or of the desired trajectories to changing exterior marginal conditions during the operation of the internal-combustion engine can be performed in a background process which is carried out at least intermittently.

The adaptation to different operating conditions of the internal-combustion engine should therefore take place beforehand, so that the result can be fixedly stored in an electronic control unit. As a function of the current operating condition of the internal-combustion engine, the controller will than operate by means of the corresponding adaptation or use a desired trajectory adapted to this operating condition. The fact of a prior adaptation indicates that this adaptation can be carried out by means of simulations and/or by means of test bench measurements.

In principle, the use of a numerical optimizing algorithm is suggested for this adaptation. In particular, the whole control process for the armature movement is to be optimized by means of at least one suitable quality criterion. One example of such a quality criterion is the impact velocity of the armature onto the solenoid coil currently capturing it, or the armature acceleration at the point in time of the impact.

However, particularly the adaptation to changing marginal conditions should take place during the operation of the internal-combustion engine, at least intermittently in a background process. In this case, it should be ensured that the corresponding electronic control unit has a sufficient computing capacity to permit such so-called continuous adaptation.

By means of the additionally suggested measures, an operation of the control or of the movement control method for the actuator is ensured also at different operating conditions of the internal-combustion engine. Furthermore, a change of the mechanical characteristics on the basis of external influences is taken into account in the control. However, this as well as a plurality of other details deviate from the above description without leaving the content of the claims.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Method for controlling movement of an armature of an electromagnetic actuator the armature being oscillated between two solenoid coils in each case against the force of at least one restoring spring, by alternating energizing of the solenoid coils, and in which when the armature approaches a first-energized coil during a capturing operation, the electric voltage applied to the coil that captures the armature, is reduced; wherein:

the capturing operation comprises a capturing phase and a braking phase;

the capturing phase of the capturing operation is followed by the braking phase;

during the braking phase, until the armature impacts on the coil, an electric voltage is applied to the coil that captures the armature in a switched manner; and respective switching points in time and a voltage switching ratio for the electric voltage are determined by a controller by means of at least a first desired trajectory describing a desired armature movement.

2. The method according to claim 1, wherein said actuator operates a charge cycle lifting valve of an internal combustion engine.

3. Method according to claim 2, wherein different desired trajectories are provided for different movement sequences of the armature of the charge cycle lifting valve.

4. Method according to claim 3, wherein in addition to a first desired trajectory guiding the lifting valve into a completely open position, at least a second desired trajectory is provided which opens the lifting valve only partially.

5. Method according to claim 4, wherein the lifting valve is held close to a closing position by means of the second desired trajectory, which opens it up only partially.

6. Method according to claim 1, wherein a constant positive or negative voltage and a "zero" voltage are alternately switched to be applied to the coil that captures the armature.

7. Method according to claim 1, wherein the controller compares estimated parameter values which define an armature movement, with the first desired trajectory.

8. Method according to claim 1, wherein the first desired trajectory is defined by values for position, velocity and acceleration of the armature over the time.

9. Method according to claim 1, wherein the first desired trajectory is calculated based on a marginal condition that acceleration of the armature at the point in time of its impact on the solenoid coil is to have a "zero" value.

10. Method according to claim 1, wherein for closing the lifting valve, the desired trajectory holds the armature at least for a short time slightly spaced away from the corresponding solenoid coil.

11. Method according to claim 1, wherein a plurality of desired trajectories are provided which move the lifting valve into end positions and in the process hold the armature spaced away from the coil which captures the armature.

12. Method according to claim 1, wherein:

the controller or the desired trajectories are adapted to different operating conditions of the internal-combustion engine; and the adaptation takes place in advance by means of a numerical optimizing algorithm and is filed in a electronic control unit.

13. Method according to claim 12, wherein:

the controller and/or the desired trajectories are additionally adapted to changing external marginal conditions; and the adaptation takes place at least intermittently in a background process during operation of the internal-combustion engine.

* * * * *